US008800183B1

(12) United States Patent
Belisle

(10) Patent No.: US 8,800,183 B1
(45) Date of Patent: Aug. 12, 2014

(54) BELISLE PICTURE PAINTING TECHNIQUE DISPLAYING DIFFERENT COLORS AT DIFFERENT VIEWING ANGLES

(71) Applicant: Brice Belisle, San Diego, CA (US)

(72) Inventor: Brice Belisle, San Diego, CA (US)

( * ) Notice: Subject to any disclaimer, the term of this patent is extended or adjusted under 35 U.S.C. 154(b) by 0 days.

(21) Appl. No.: 13/860,529

(22) Filed: Apr. 11, 2013

(51) Int. Cl.
*G09F 19/14* (2006.01)

(52) U.S. Cl.
CPC ..... *G09F 19/14* (2013.01)
USPC ..... 40/453

(58) Field of Classification Search
USPC ..... 40/453, 454; 434/84, 96, 98, 103, 303; 472/58, 61; 446/219
See application file for complete search history.

(56) References Cited

U.S. PATENT DOCUMENTS

| | | | | |
|---|---|---|---|---|
| 386,780 | A * | 7/1888 | Heinemann | 40/453 |
| 3,586,592 | A * | 6/1971 | Cahn | 428/29 |
| 6,133,892 | A * | 10/2000 | Borgwardt | 345/1.3 |

* cited by examiner

*Primary Examiner* — Joanne Silbermann
(74) *Attorney, Agent, or Firm* — Robert W. J. Usher

(57) ABSTRACT

A picture has a paint receiving substrate covered by an array of bowl-shape indentations, each of which is marked around an interior periphery with different colors such that different amounts of said different colors are exposed to spectator view at respectively different angles of view together forming composite visual subject matter which varies in color when viewed from different angles. Some indentations have vertically extending surface portions adjacent their mouths and spaced apart from their mouths which can be round or hexagonal in shape.

18 Claims, 4 Drawing Sheets
(2 of 4 Drawing Sheet(s) Filed in Color)

BELISLE PICTURE PAINTING TECHNIQUE DISPLAYING DIFFERENT COLORS AT DIFFERENT VIEWING ANGLES

FIELD OF THE INVENTION

The invention relates to a picture painting technique which results in a painted region appearing different in at least one of color (hue) and brightness when viewed from different angles.

BACKGROUND OF THE INVENTION

Artist/painters are always seeking techniques for improving the appeal of a picture to a spectator. Some artists have devoted their lives to exploring the effect that particular colors have on each other. It is also commonly known to artists that colors are affected dramatically by other specific colors that are place adjacent or nearby—without needing to be mixed amorphously on a palette. A particular example of such technique where different colors are applied as discrete 'spots', possibly even as a mosaic of different colors, is known as 'impressionism'. The sizes and shapes of the 'spots' are two of many variables in color effect. However, the general appearance of the picture, at least for color effect, usually remains much the same when viewed from different angles, for example, during spectator movement, Such static quality does not increase spectator stimulation and appeal.

SUMMARY OF THE INVENTION

According to one aspect, the invention provides a picture comprising a paint receiving substrate formed with a series of indentations, each indentation having interior surface portions which face in different directions and are one of differently colored and shaded thereby exposing different amounts of such colored portions to spectator view at respectively different angles of view so that the indentations together form a composite picture which varies in one of said hue and shade, respectively, when viewed from different angles.

Thus, when the spectator changes his line of sight (by moving), changing amounts/area sizes or combinations of colors are exposed to his view, new colors possibly being introduced with others being eliminated, providing an intriguing predicament to both the artist and the spectator, enhancing interest and appeal This is called the Belisle painting technique in which much of the color is added or eliminated, not by physical application/rendering but by the movement of the spectator.

Preferably, the differently colored or shaded portions are on opposite sidewalls of an indentation such that the different angles of view are in opposite directions to each other.

The portions of the indentations may be round and marked/rendered in different colors or shades and differently positioned/angled around an interior surface thereof at least a periphery thereof.

The substrate may comprise a board, a paper or plastic sheet or other suitable material. The indentations/depressions may comprise a variety of bowl-shaped concavities which are wholly or partly hemispherical with circular or rectangular mouths/openings, or, hexagonal openings for ease of positioning closely together and to obtain any desired maximum packing fraction. Alternatively, the indentations can be of any shape or size, without definite character or unity, that is, amorphous and may even communicate with one another.

The rendering or painting is such that the main angles are on a left side to right side (horizontal) plane. There can be an up and down element, but that is generally of less importance. Increasing the depths of the indentations/depressions can create a significant difference. Vertical portions of the interior surfaces (extending perpendicular to the substrate) cannot be seen when the picture (painted substrate) is viewed perpendicularly (at 90 degrees) i.e. by a spectator standing directly in front, so that an abrupt, even startling, change in color is possible when the spectator shifts his viewing position only a little, from directly in front of the picture to one side.

It will be appreciated that the open mouths of the indentations provide apertures exposing the colored areas within in the depressions.

The indentations/concavities are preferably sufficiently large to enable different surface portions thereof to be painted with a conventional artist's tools such as a conventional artists brush, a crayon, palette knife or even an automatic paint applying mechanism such as an ink-jet printer. Frequently, a painter's substrate would comprise thousands of such indentations.

The major painting surface should be smooth, not necessarily flat, the sizes (widths) and depths of the bowl-form indentations are critical in controlling which colors are seen, hidden neutralized or emphasized. The interstices will vary depending on the size shape and placement of the indentations and will generally depict the 'gist' of the painting while the colors on the inside surfaces of the indentations would enhance, neutralize or emphasize colors of adjacent areas.

BRIEF DESCRIPTION OF THE DRAWINGS

The patent or application file contains at least one drawing executed in color. Copies of this patent or patent application publication with color drawings will be provided by the Office upon request and payment of the necessary fee.

In order that the invention may be readily understood, specific embodiments thereof will now be described by way of example only and with reference to the accompanying drawing in which.

DESCRIPTION OF PARTICULAR EMBODIMENTS

Figure 1A:
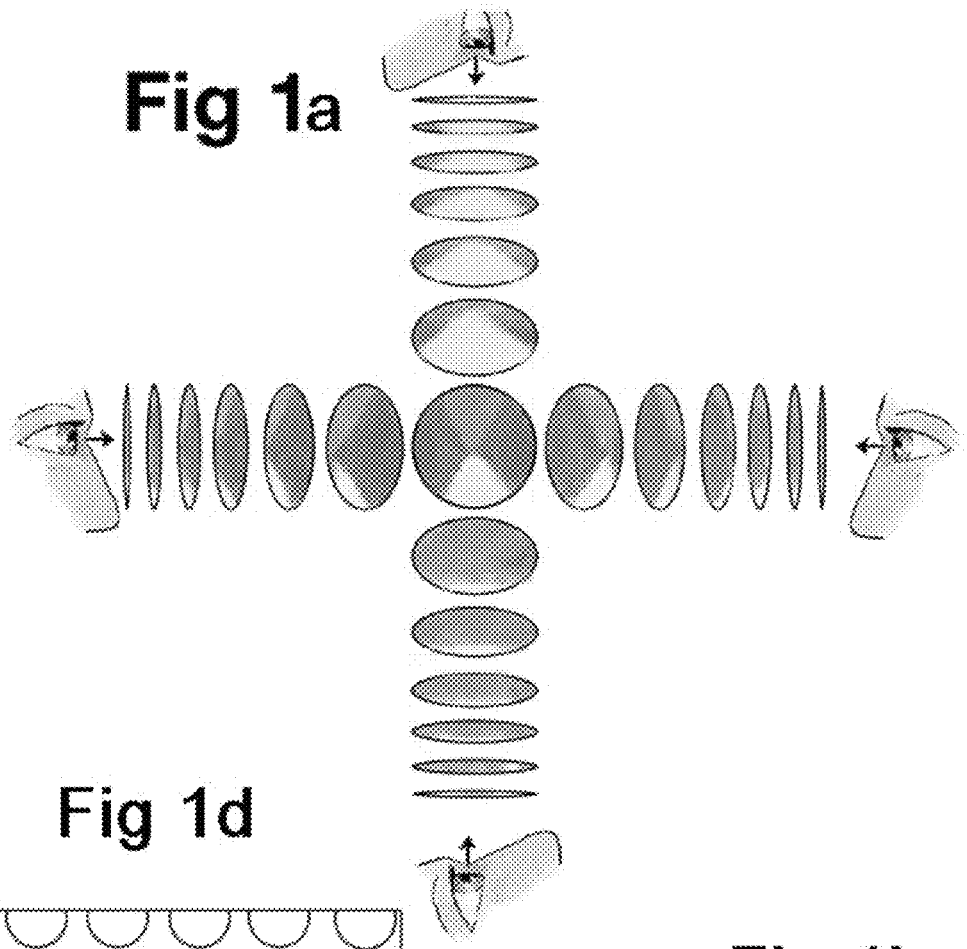
FIG. 1*a* is a schematic showing appearances of a single, multi-colored bowl of a first embodiment, when viewed from the front and four directions on perpendicular axes at progressively increasing separations and correspondingly decreasing oblique angles.
Figure 1D:
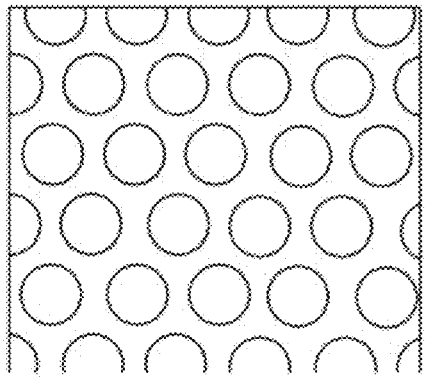
FIG. 1*d* is a schematic plan view of bowls arrayed equidistantly in one symmetrical pattern forming a network of indentations.
Figure 1B:
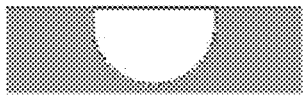
FIG. 1*b* is a schematic cross-sectional view through the center of the bowl.
Figure 1C:
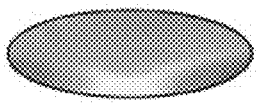
FIG. 1*c* is an enlarged oblique view of the bowl.
Figure 2:
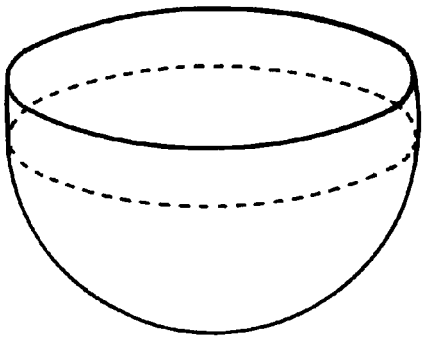
FIG. 2 is a schematic showing an enlarged view of a single spherically bottomed bowl of ½ inch diameter with a cylindrical mouth/lip ⅛ inch high providing a vertical painting surface.
Figure 3:
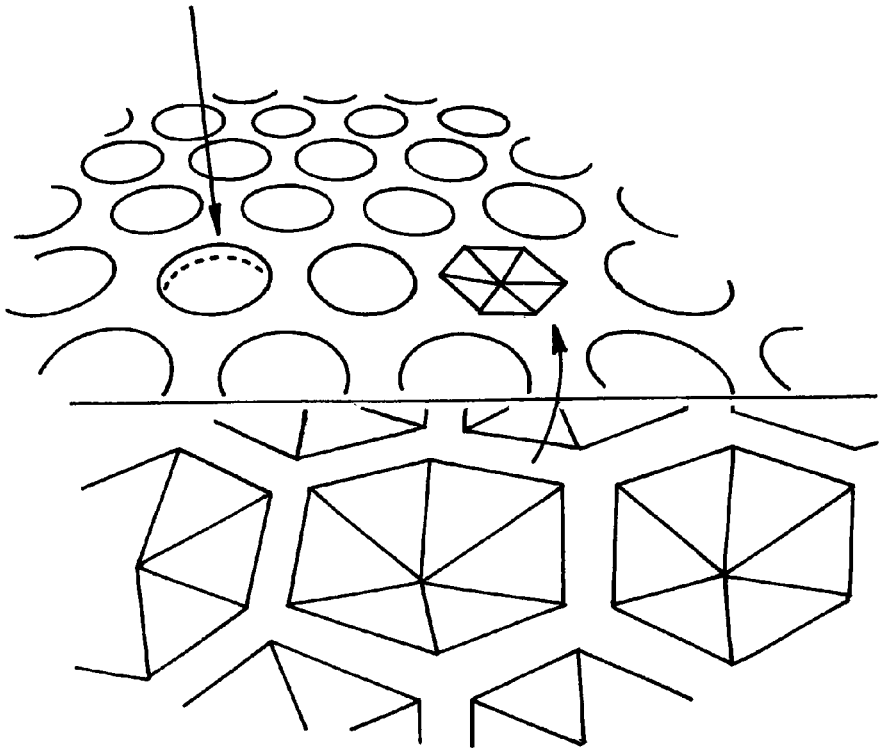
FIG. 3 is a schematic showing a symmetrical array of equidistant hexagonally mouthed bowls according to a second embodiment.

As shown in FIG. 1*a*, a bowl-form indentation with a circular top is divided into quadrants painted with red, yellow, blue and green colors (clockwise from the top). As the spectator moves from a front viewing position, perpendicular to the substrate, away from the indentation progressively to the right, the bowl appears progressively more elliptical and the relative amounts seen of green, yellow and most especially red diminish progressively diminish as the angle of view becomes more acute with red eventually completely disappearing and blue dominating, as colors on portions of the inside surface of the bowl facing away from the spectator cannot be seen and only portions facing the spectator remain visible.

Figure 5:
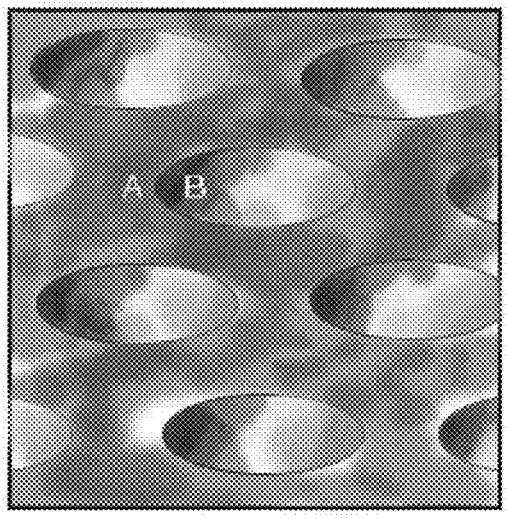
FIG. 5 is a perspective view of an array of multi-colored bowls.

A similar effect occurs with progressive downward movement of the spectator with green becoming progressively more dominant; progressive leftward movement in which green becomes progressively more dominant; leftward movement in which red becomes progressively more dominant; and, progressive upward movement with yellow becoming progressively more dominant to the eventual exclusion of all other colors except possibly very small areas adjacent the tips of the ellipses. Isolating the color on the side facing the spectator can have an enormous effect on it's immediate area The painting surface is not necessarily flat. An uneven, undulating surface introduces creative possibilities In FIG. 5, reference A indicates a flat substrate area between the bowl-form indentations which forms the normal painting surface while B indicates the multicolored internal surfaces of the bowls. The color impression of area A remains constant at all angles of view, while B provides the variable that will influence what is actually seen by the viewer. Colors which influence each other when adjacent are placed in area B so that they will selectively be seen (in combination with the entire painting) at certain angles of view. Area A would constitute the 'meat' of the painting and area B, the ever-changing 'seasoning.'

Figure 4:
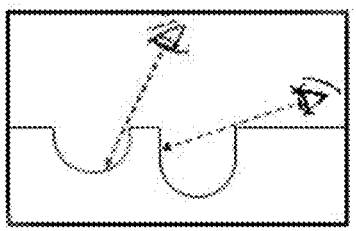
FIG. 4 is a schematic cross section showing two spherically bottomed bowls with cylindrical mouths/lips of respectively different heights.

Differences of depth, as indicated in FIG. 4, create significant differences in appearance Vertical wall portions will not be seen when the painting is viewed from the front (perpendicularly).

Figure 6A:
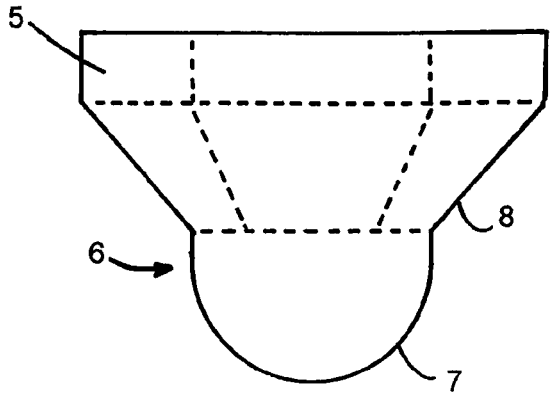
FIGS. 6A, 6B and 6C are schematics showing enlarged views at greater and lesser scale, respectively, and a plan view of a preferred hexagonally mouthed bowl; and, FIG. 7 is a diagrammatic plan view showing the even spacing obtained in an array of bowls according to FIGS. 6A, 6B and 6C, closely packed together.
Figure 6C:
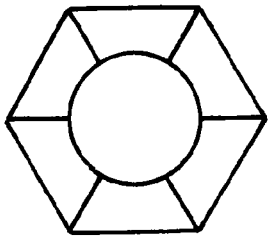
Figure 6B:
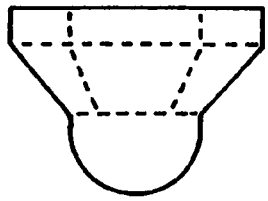

FIGS. 6*a*, 6*b* and 6*c* show a preferred, hexagonal, aperture forming mouth bowl of ¾ inch width, as measured between opposite flat sides, and ¾ inch depth and with first and second vertically extending painting surfaces 5 and 6. The first of said vertical surfaces 5 is faceted as a result of the hexagonal shape and extends vertically downwardly from the mouth aperture for ⅛ inch, and the second 6 is formed by uppermost, diametrical wall parts, spaced 7/16 inch below the mouth aperture of a spherical ½ inch diameter bottom 7. The vertically extending surfaces are spaced apart from each other by a transitional portion 8 of hexagonal cross-section forming corresponding facets which converge as it extends downward away from the first vertical surface 5 and has a vertical extent of 5/16 inch. The lower, vertically extending surface is substantially cylindrical being formed at the top, circular, diametrical location of a spherical bottom of ½ inch diameter.

The two vertical surfaces of this preferred embodiment provide additional opportunities for the artist to manipulate colors, hiding or emphasizing them. The effect on the spectator can be dramatic depending on such factors as the depth of the indentation/cavity and appropriate lighting. The abrupt changes in angle of view/sight angle between adjacent facets affords correspondingly abrupt, perceived color shifts when the spectator changes his angular viewing position. It should be emphasized that the finished painting must be well lit to eliminate/avoid any shadows which could destroy the effect.

Figure 7:
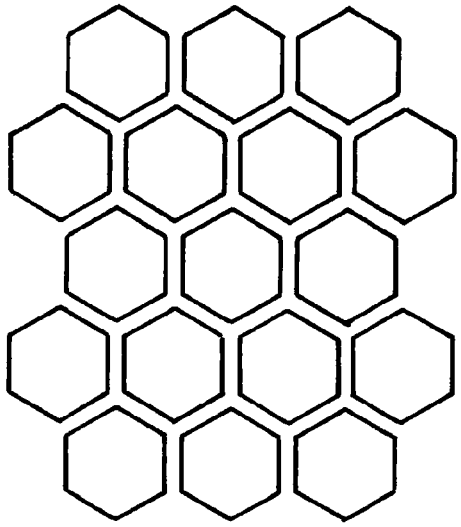

As shown in FIG. 7, in the array of hexagonal bowls apices/points of each bowl are positioned uppermost when the painted picture/substrate is hanging vertically.

The invention claimed is:

1. A picture comprising a paint receiving substrate formed with a series of bowl-shape indentations, each indentation having interior surface portions which face in different directions and are one of differently colored and differently shaded from each other and include respective vertically extending parts whereby such different colors and different shades on said parts cannot be seen when viewed perpendicularly by a spectator positioned directly in front of said parts and, respective ones of such different colors and shades on respective parts can be seen only alternately, one at a time, when viewed at different angles from respective of said different directions, and together form composite visual subject matter which varies in said one of said color and shade, respectively, when viewed from respective of said different directions.

2. A picture according to claim 1 wherein, said one of differently colored and shaded portions are on respectively opposite sidewalls of at least some of said vertically extending parts such that the different angles of view are in opposite directions to each other.

3. A picture according to claim 1 wherein said vertically extending parts are arranged as a first series and a second series spaced vertically apart at different depths, adjacent mouths of the indentations and below mouths of the indentations, respectively.

4. A picture according to claim 3 wherein said opposite sidewalls of the second series are spaced apart from each other by a less distance than a distance by which said opposite sidewalls of the first series are spaced apart from each other.

5. A picture according to claim 4 wherein the first series are joined to the second series by respective sidewall portions which converge as they extend away from the mouths.

6. A picture according to claim 5 wherein said indentations have hexagonal mouths such that the opposed sidewalls of the first series are correspondingly faceted.

7. A picture according to claim 3 wherein said indentations have hemispherical bases with the second series formed by uppermost, diametrical portions of the bases, most adjacent the mouth.

8. A picture according to claim 3 wherein the first series are joined to the second series by respective sidewall portions which converge as they extend away from the mouths which are hexagonal such that said vertically extending parts of the first series are correspondingly faceted which facets extend away from the mouth forming the sidewall portions which converge.

9. A picture according to claim 1 wherein mouths of said bowl-shape indentations are hexagonal.

10. A method for painting a picture comprising the steps of:

providing a paint receiving substrate formed with a series of bowl-shape indentations, each indentation having interior surface portions which face in different directions thereby exposing different amounts of such portions to spectator view at respectively different angles of view, the interior surface portions including vertically extending surface portions adjacent their mouths which cannot be seen when viewed perpendicularly by a spectator positioned directly in front of said vertically extending surface portions and, said vertically extending surface portions can be seen only alternately, one at a time, when viewed at different angles from respective of said different directions, and applying one of different color and different shade to respective interior surface portions of each indentation through an indentation mouth such that different amounts of said one of color and shade are exposed to spectator view at respectively different angles, together forming composite visual subject matter which varies in said one of said hue and shade, respectively, when viewed from different angles and respective ones of such different colors and shades on respective vertically extending surface portions cannot be seen when viewed perpendicularly by a spectator positioned directly in front of said vertically extending surface portions and can be seen only alternately, one at a time, when viewed at different angles from respective of said different directions.

11. A method for painting according to claim 10 wherein said one of differently colored and shaded portions are on respectively opposite sidewalls of an indentation such that the different angles of view are in opposite directions to each other.

12. A method according to claim 11 wherein indentations are bowl-shape.

13. An artists painting substrate comprising a smooth surfaced board covered by an array of paint receiving, bowl-shape indentations, each indentation having an aperture forming mouth and different, interior, paint receiving surface portions positioned to receive paint/dye of respectively different hues/shades applied through the aperture forming mouth and facing in respectively different directions exposing different amounts of said different surface portions and therefore different hues to spectator view through the aperture forming mouth at respectively different angles of view, so that the array forms composite visual subject matter which varies in hues/shades respectively when viewed from different angles, said surface portions including vertically extending parts which cannot be seen when viewed perpendicularly by a spectator positioned directly in front of said parts and, said parts and respective ones of such different colors and shades received on respective parts can be seen only alternately, one at a time, when viewed at different angles from respective of said different directions.

14. An artists painting substrate according to claim 13 wherein said vertically extending parts are provided as a first series and a second series adjacent the aperture forming mouths and remote from the aperture forming mouths respectively, and spaced apart by surface portions which converge as they extend away from the mouths.

15. An artists painting substrate according to claim 14 wherein said aperture forming mouths are hexagonal and said vertically extending parts are of hexagonal cross-section, providing paint receiving facets.

16. An artists painting substrate according to claim 14 wherein said aperture forming mouths are hexagonal and said first series of vertically extending parts and convergent surface portions are of hexagonal cross-section providing discrete paint receiving facets.

17. An artists painting substrate according to claim 16 wherein said indentations have hemispherical bases and the second series of vertically extending parts formed by diametrical portions of the bases, most adjacent the mouth.

18. An artists painting substrate according to claim 13 wherein mouths of said bowl-shape indentations are hexagonal.

* * * * *